US006742911B1

(12) United States Patent
Chen

(10) Patent No.: US 6,742,911 B1
(45) Date of Patent: Jun. 1, 2004

(54) REAR PUSHBUTTON TYPE SWITCH ARRANGEMENT FOR ALLUMINUM ALLOY FLASHLIGHT

(76) Inventor: Chin Hsiang Chen, 40, Lane 398, Fu Chiang Road, Sec. 2, Yung Kang, Tainan (TW)

( * ) Notice: Subject to any disclaimer, the term of this patent is extended or adjusted under 35 U.S.C. 154(b) by 8 days.

(21) Appl. No.: 10/317,782

(22) Filed: Dec. 11, 2002

(51) Int. Cl.[7] ..... F21L 4/04

(52) U.S. Cl. ..... 362/206; 362/95; 362/226; 362/208; 362/374; 362/375; 362/457; 200/313; 200/314

(58) Field of Search ..... 362/206, 95, 208, 362/362, 374, 375, 457; 200/310–314, 329, 330, 331, 335, 315, 341, 345

(56) References Cited

U.S. PATENT DOCUMENTS 4,956,755 A * 9/1990 Maglica et al. ..... 362/206

6,092,910 A * 7/2000 Sung ..... 362/206

* cited by examiner

*Primary Examiner*—Sandra O'Shea
*Assistant Examiner*—Sharon Payne
(74) *Attorney, Agent, or Firm*—Pro-Techtor International Services

(57) ABSTRACT

A rear pushbutton type switch arrangement for flashlight formed of an aluminum alloy barrel holding a battery set and a lamp assembly, an electrically conducting rotary rear cap provided at a rear side of said barrel and a switch structure is disclosed. The switch structure has an externally threaded, electrically conducting, hollow, cylindrical metal casing connected between the barrel and the rotary cap to hold the other parts of the switch structure firmly in the rotary rear cap so that the other parts of the switch structure do not fall from the rotary rear cap when disconnected from the barrel for a replacement of the battery set.

6 Claims, 9 Drawing Sheets

A-A'

REAR PUSHBUTTON TYPE SWITCH ARRANGEMENT FOR ALLUMINUM ALLOY FLASHLIGHT

BACKGROUND OF THE INVENTION

1. Field of the Invention

The present invention relates to an aluminum alloy flashlight and, more specifically, to a rear pushbutton type switch arrangement for flashlight.

2. Brief Description of the Related Art

FIGS. 1 and 2 show an aluminum alloy flashlight constructed according to the prior art (equivalent to U.S. Pat. No. 6,092,910). According to this design, the flashlight comprises an aluminum alloy barrel 10 holding a battery set (set of battery cells) a and a lamp assembly on the front side, a rotary rear cap 20 made of electrically conductive material and threaded into the rear end of the barrel 10, and a switch structure 30 mounted within the rotary rear cap 20 and partially extended out of the center through hole 201 of the rotary rear cap 20. The switch structure 30 comprises a spring set 301, a switch body 302, and a button 303. The spring set 301 comprises a metal spring 3011 and an electrically insulative spring holder 3012. The metal spring 3011 is mounted in the spring holder 3012 and extended out of the front side of the spring holder 3012. When received in the rotary rear cap 20, the front end of the metal spring 3011 is suspended out of the rotary rear cap 20 and stopped against one end (the negative terminal) of the battery set a. The switch body 302 comprises two lead out pins 3021 respectively connected to the metal spring 3011 and the inside wall of the rear rotary cap 20, and a switching rod 3022 coupled to the button 303. The button 303 has a press portion 3031 extended out of the rotary rear cap 20 through the center through hole 201. When the user pressed the press portion 3031, the switching rod 3022 is forced to switch on/off the switch structure 30, and to further turn on/off the flashlight.

This design of aluminum alloy flashlight is still not satisfactory in function. Because there is provided no positioning means to stop the spring set 301 in place, the spring set 301 tends to jump out of the rotary rear cap 20 when the rotary rear cap 20 disconnected from the barrel 10 for the replacement of the battery set a (see FIG. 4). Further, if the spring set 301 is not accurately set in position, the lead out pins 3021 may not be positively maintained in contact with the metal spring 3011 and the inside wall of the rotary rear cap 20, resulting in an error of contact (see FIG. 5).

Therefore, it is desirable to provide an aluminum alloy flashlight that eliminates the aforesaid drawbacks.

SUMMARY OF THE INVENTION

The present invention has been accomplished to provide a rear pushbutton type switch arrangement for flashlight, which eliminates the aforesaid drawbacks. It is the main object of the present invention to provide a rear pushbutton type switch arrangement for flashlight, which keeps the component parts of the switch structure firmly positioned inside the rotary rear cap after removal from the barrel of the flashlight for a replacement of the battery set. According to the present invention, the rear pushbutton type switch arrangement for flashlight comprises an aluminum alloy barrel holding a battery set and a lamp assembly, an electrically conducting rotary rear cap provided at a rear side of the barrel, and a switch structure mounted in the barrel and the rotary rear cap and partially extended out of the rotary rear cap for operation by the user to switch on/off the flashlight. The switch structure comprises an externally threaded, electrically conducting, hollow, cylindrical metal casing, the casing having a front end threaded into a rear end of the barrel, a rear end screwed up with the rotary rear cap, a small front axial hole and a big rear axial hole axially connected in a line, and an annular stop flange in front of the small front axial hole; a spring set mounted in the small front axial hole of the casing, the spring set comprising an electrically insulating spring holder mounted inside the casing and stopped behind the annular stop flange of the casing, and a metal spring isolated from the casing by the spring holder, the metal spring having a front end disposed in contact with the negative terminal of the battery set and a rear end; a switch body mounted in the big rear axial hole of the casing, the switch body comprising two pairs of first front lead out pins transversely arranged in parallel at a front side thereof and overlapped for connection to the rear end of the metal spring, a pair of second front lead out pin bent bilaterally backwards and maintained attached to the periphery of the switch body for contacting an inside wall of the rotary rear cap, and a rear switching rod; and a button coupled to the switching rod of the switch body and suspending in the rotary rear cap, the button having a press portion extended out of the rotary rear cap for operation by the user.

DETAILED DESCRIPTION OF THE PREFERRED EMBODIMENT

Figure 1:
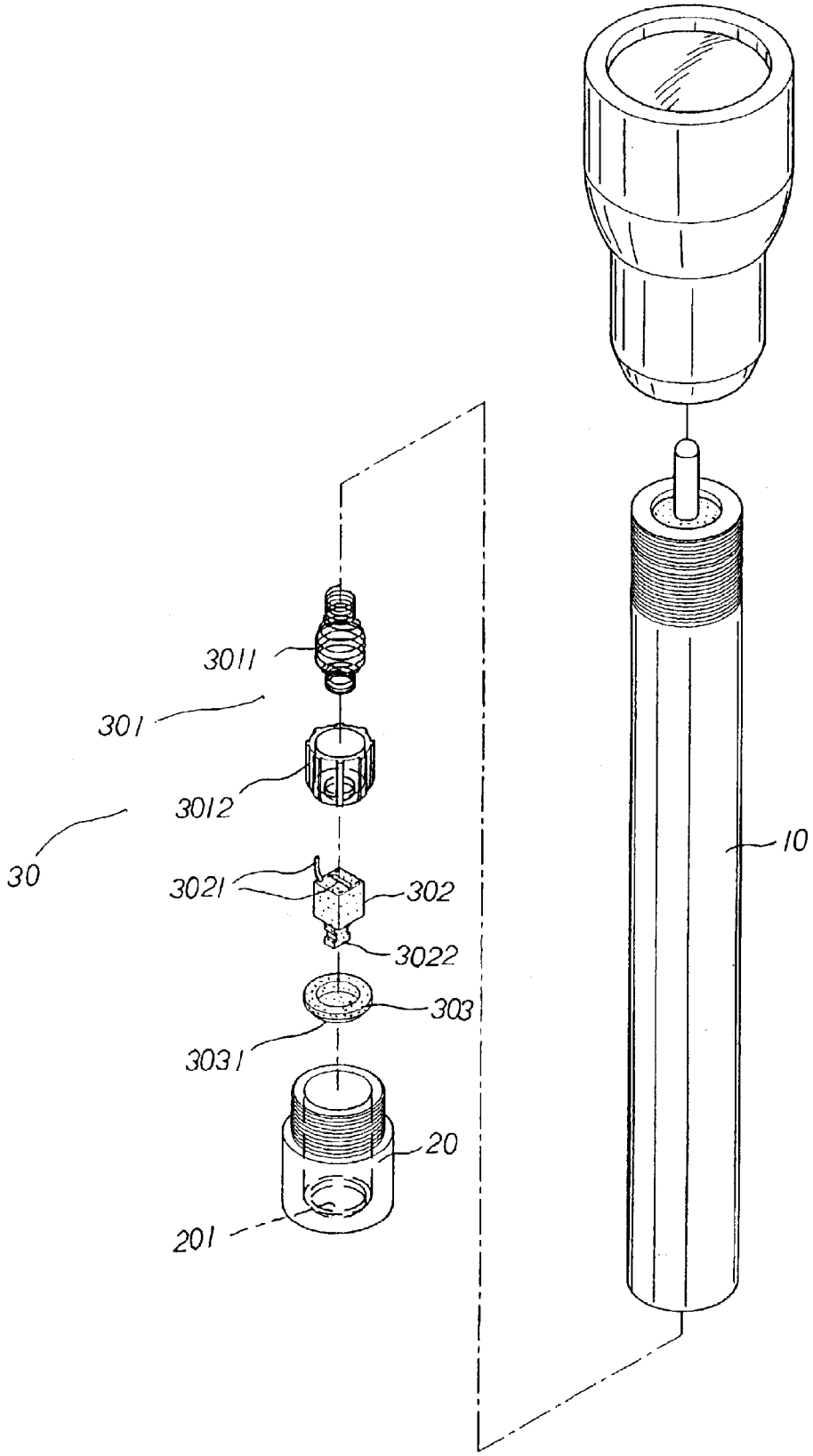
FIG. 1 (Prior Art)
FIG. 1 is an exploded view of a flashlight according to the prior art design.
Figure 2:
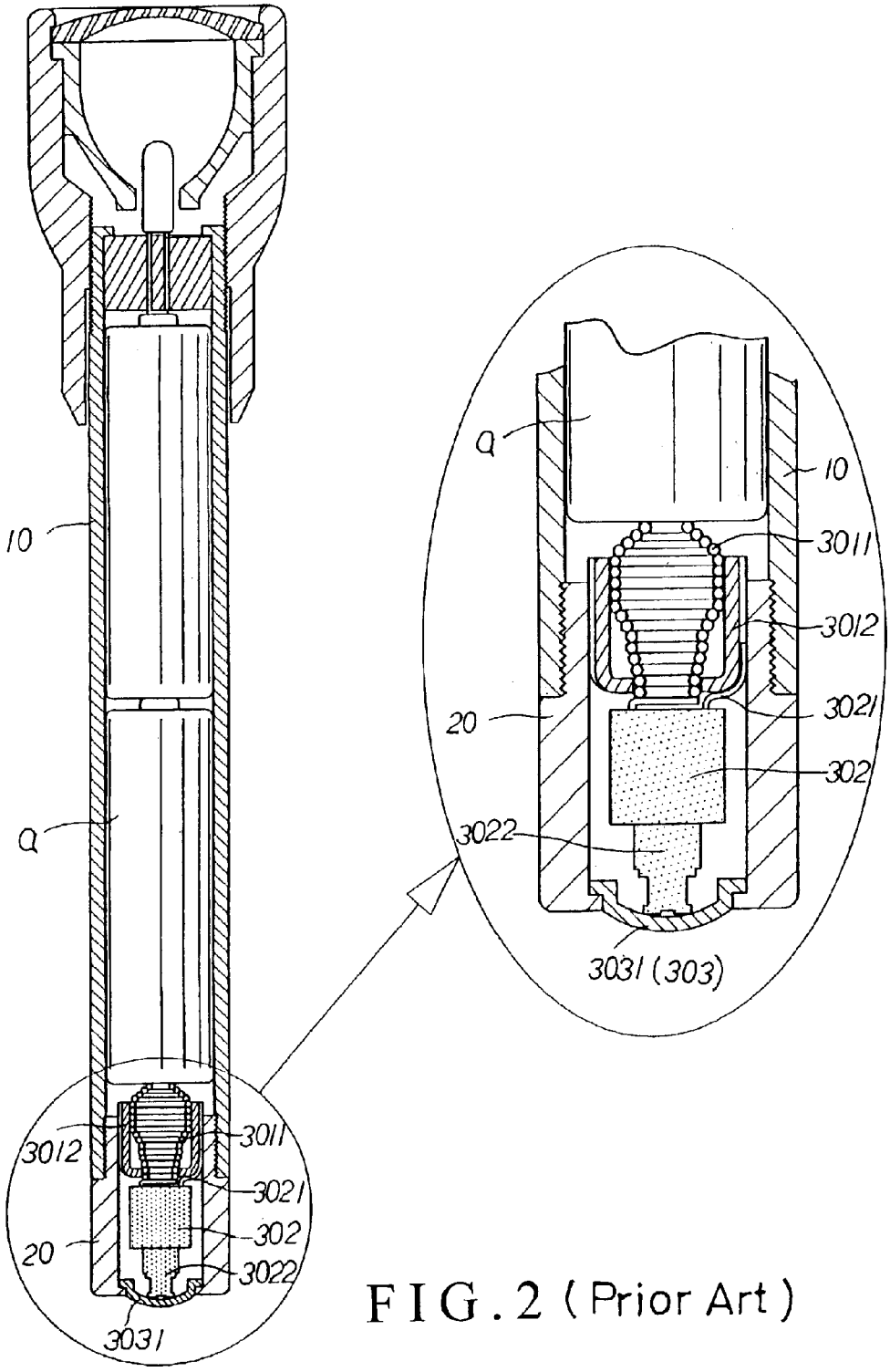
FIG. 2 (Prior Art)
FIG. 2 is a sectional assembly view of the prior art design.
Figure 3:
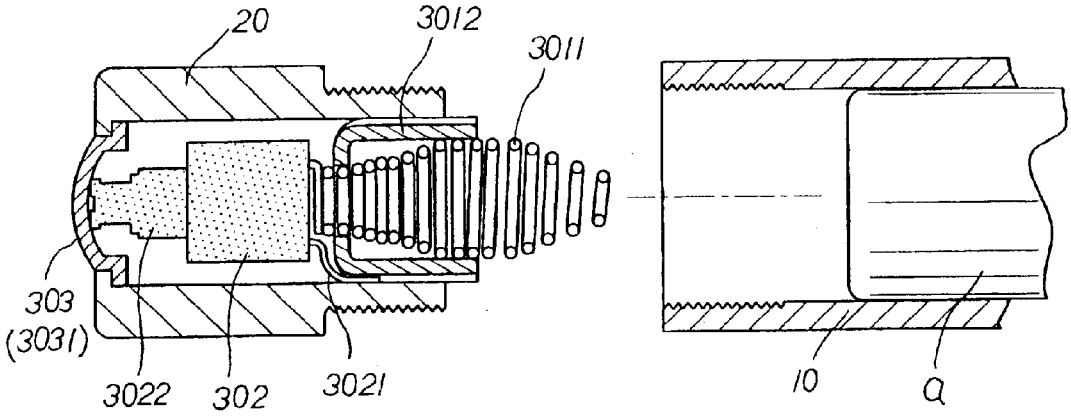
FIG. 3 (Prior Art)
FIG. 3 is schematic sectional view showing the rotary rear cap disconnected from the aluminum alloy barrel according to the prior art design.
Figure 4:
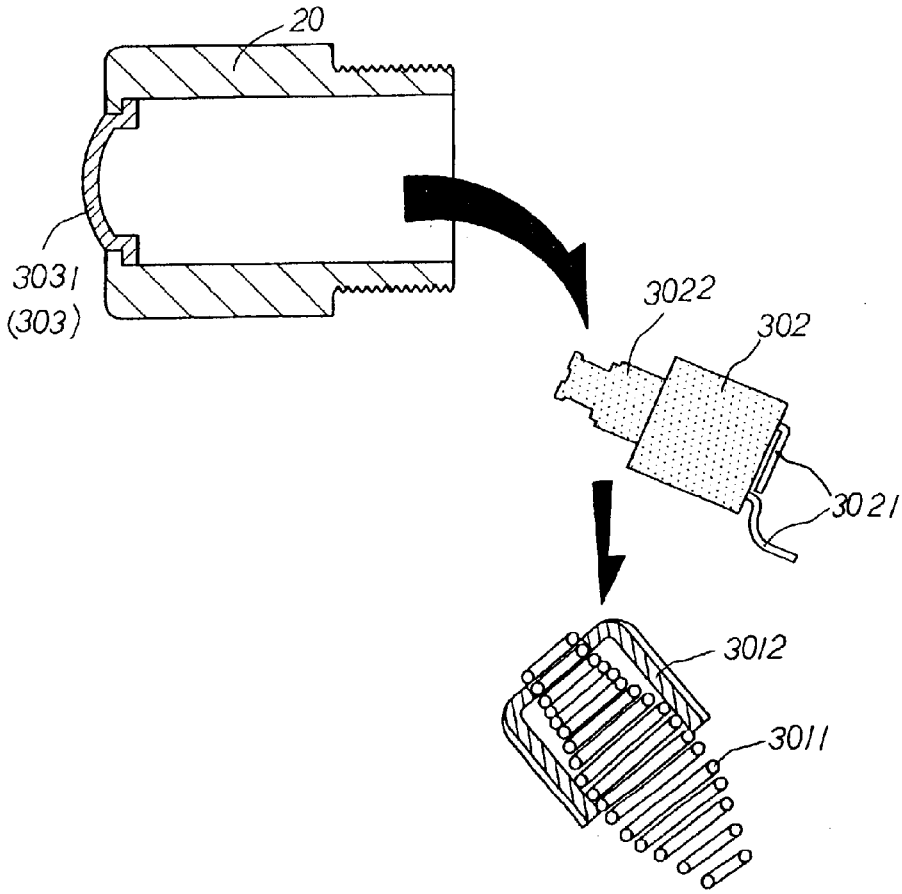
FIG. 4 (Prior Art)
FIG. 4 is a schematic drawing showing the spring set and switch body fell from the rotary rear cap after removal of the rotary rear cap from the aluminum alloy barrel according to the prior art design.
Figure 5:
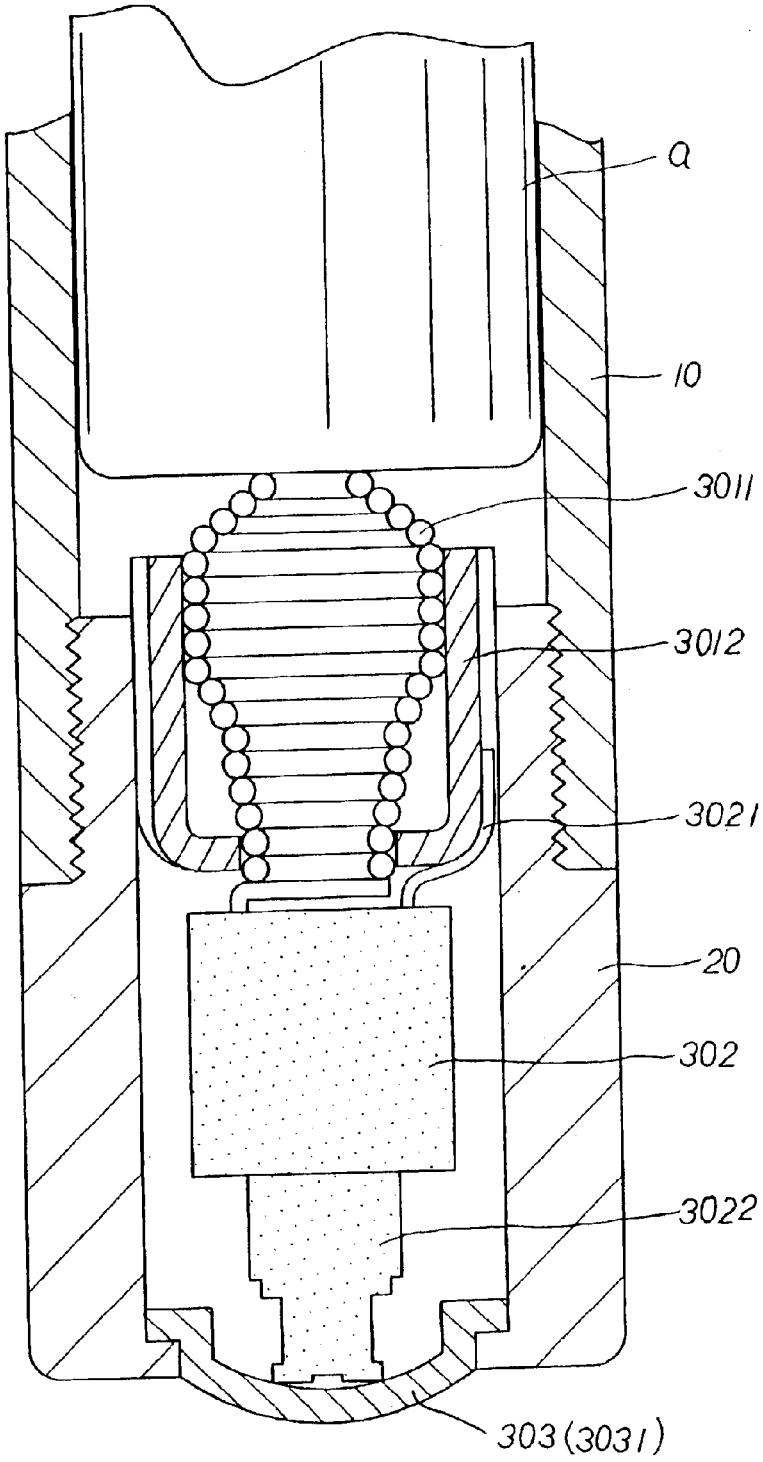
FIG. 5 (Prior Art)
FIG. 5 is a schematic sectional view showing an unstable contact between the corresponding lead out pin of the switch body and the inside wall of the rotary rear cap according to the prior art design.
Figure 6:
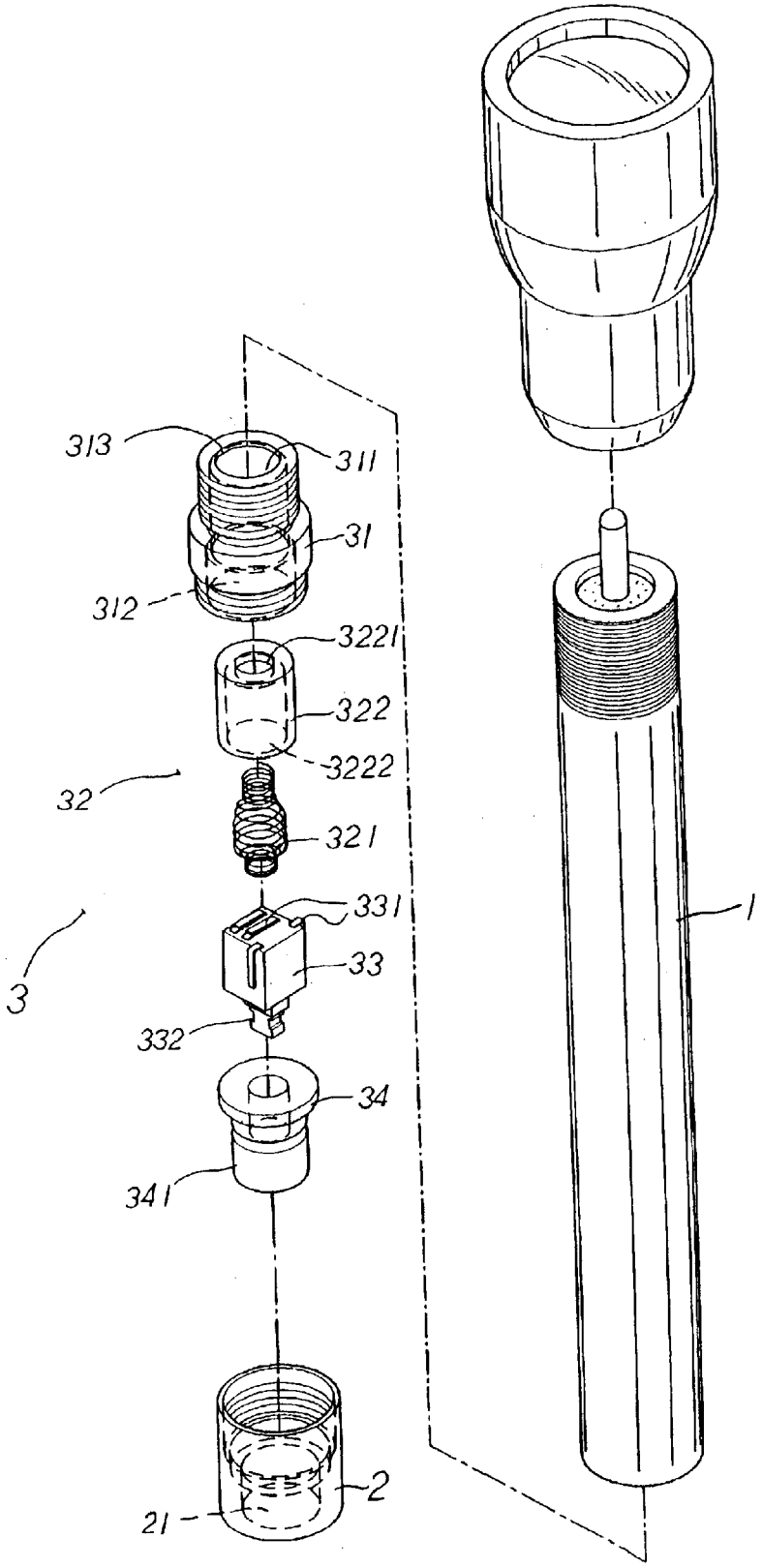
FIG. 6 is a perspective exploded view of the present invention.
Figure 7A:
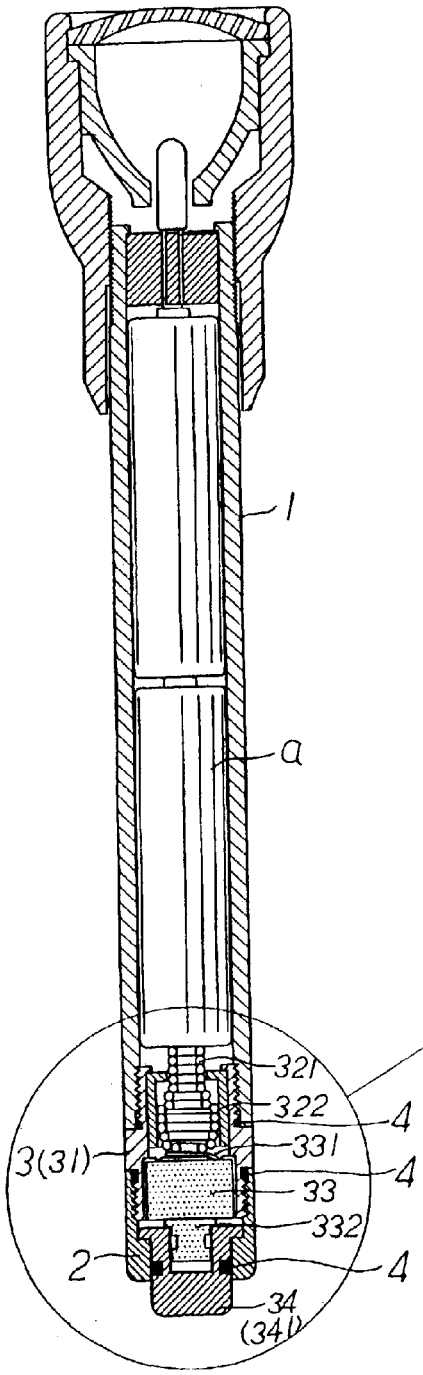
FIG. 7A is a sectional assembly view of FIG. 6.
Figure 7B:
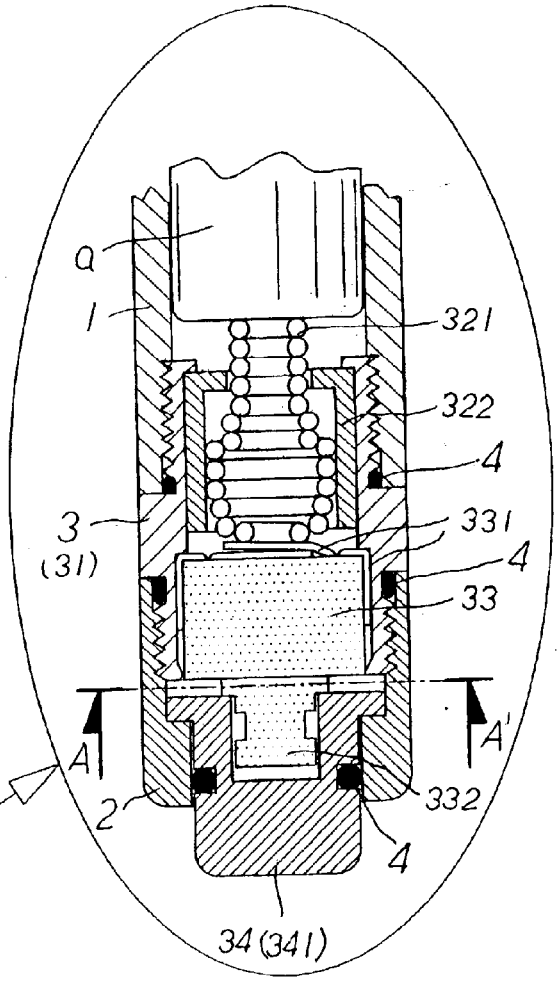
FIG. 7B is an enlarged view of a part of FIG. 7A.
Figure 8:
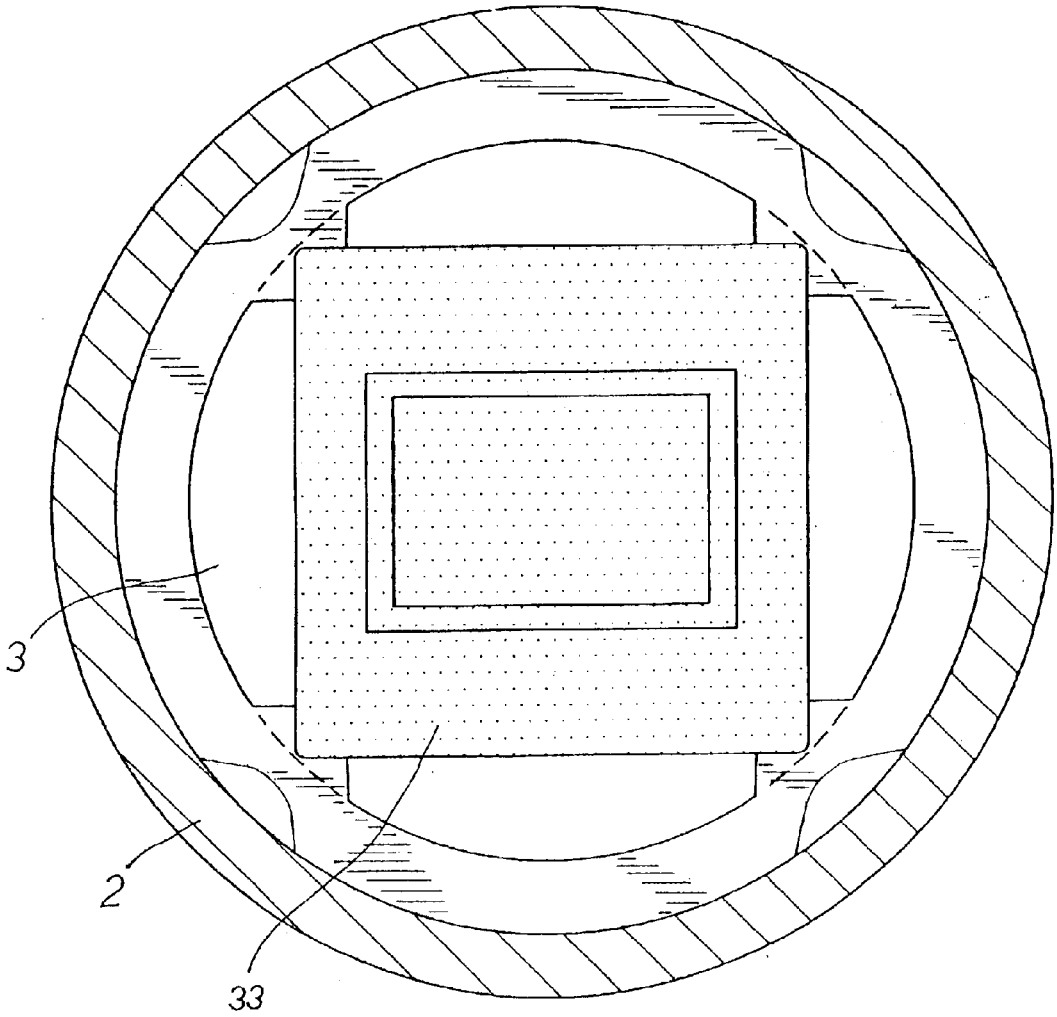
FIG. 8 is a sectional view in an enlarged scale taken along line A–A' of FIG. 7B.

Referring to FIGS. 6, 7A, and 7B, a rear pushbutton type switch arrangement in accordance with the present invention is shown comprised of an aluminum alloy barrel 1 holding a battery set a and a lamp assembly, an electrically conducting rotary rear cap 2 provided at the rear side of the barrel 1, and a switch structure 3 mounted in between the barrel 1 and the rotary rear cap 2. The switch structure 3 comprises a casing 31, a spring set 32, a switch body 33, and a button 34.

The casing 31 is an externally threaded, electrically conducting, hollow, cylindrical metal member connected between the barrel 1 and the rotary rear cap 2 (the front end of the casing 31 is threaded into the rear end of the barrel 1, and the rotary rear cap 2 is threaded onto the rear end of the casing 31), having a small front axial hole 311 and a big rear axial hole 312 axially connected in a line, and an annular stop flange 313 in front of the small front axial hole 311.

The spring set 32 comprises a metal spring 321, and an electrically insulative, hollow, cylindrical spring holder 322. The spring holder 322 has a small front hole 3221 and a big rear hole 3222. The metal spring 321 is mounted in the spring holder 322, having a front end extended out of the small front hole 3221 and stopped against the negative terminal of the battery set a and a rear end extended out of the big rear hole 3222.

The switch body 33 comprises three pairs of front lead out pins 331 (two pairs of front lead out pins 331 are transversely arranged in parallel at the front side and overlapped for contacting the rear end of the metal spring 321, and the other pair of front lead out pin 331 is bent bilaterally backwards and closely attached to the periphery of the switch body 33 for contacting the inside wall of the rotary rear cap 2) and a rear switching rod 332. The button 34 is mounted in the rotary rear cap 2, having a press portion 341 extended out of the rear center hole 21 of the rotary rear cap 2.

During installation, the spring set 32 is mounted in the small front axial hole 311 of the casing 31 keeping the spring holder 322 stopped behind the annular stop flange 313, and then the switch body 33 is press-fitted into the big rear axial hole 312, and then the button 34 is coupled to the rear switching rod 332 of the switch body 33, and then the rotary rear cap 2 is threaded onto the rear end of the casing 31 for enabling the press portion 341 of the button 34 to be extended out of the rear center hole 21 of the rotary rear cap 2, and then the casing 31 is threaded into the rear end of the barrel 1, keeping the lead out pins 331 respectively positively maintained in contact with the metal spring 321 and the inside wall of the rotary rear cap 2. When installed, the user can operate the press portion 341 of the button 34 to switch on/off the switch body 33, so as to further close/open the lamp assembly of the flashlight. (the negative terminal of the battery set a is connected to the negative terminal of the switch body 33 through the metal spring 321, and the positive terminal of the battery set a is connected to the positive terminal of the switch body 33 through the lamp assembly of the flashlight, the barrel 1 and the rotary rear cap 2).

Figure 9:
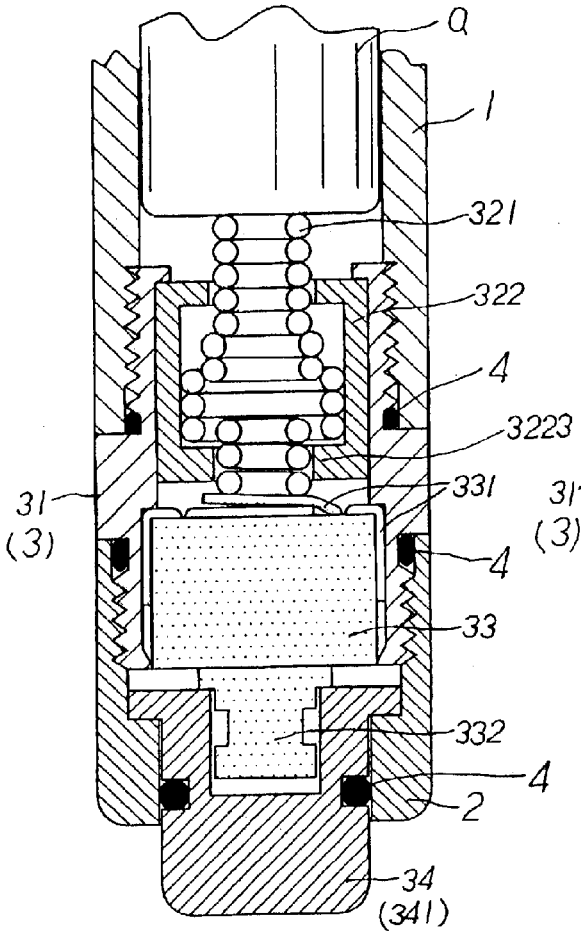
FIG. 9 is a plain view of an alternate form of the present invention.

FIG. 9 shows an alternate form of the present invention. According to this embodiment, the spring holder 322 comprises a rear inside annular stop flange 3223 adapted to support the rear end of the metal spring 321 in position, preventing biasing of the metal spring 321 to contact the wrong lead out pins of the switch body 33.

Figure 10:
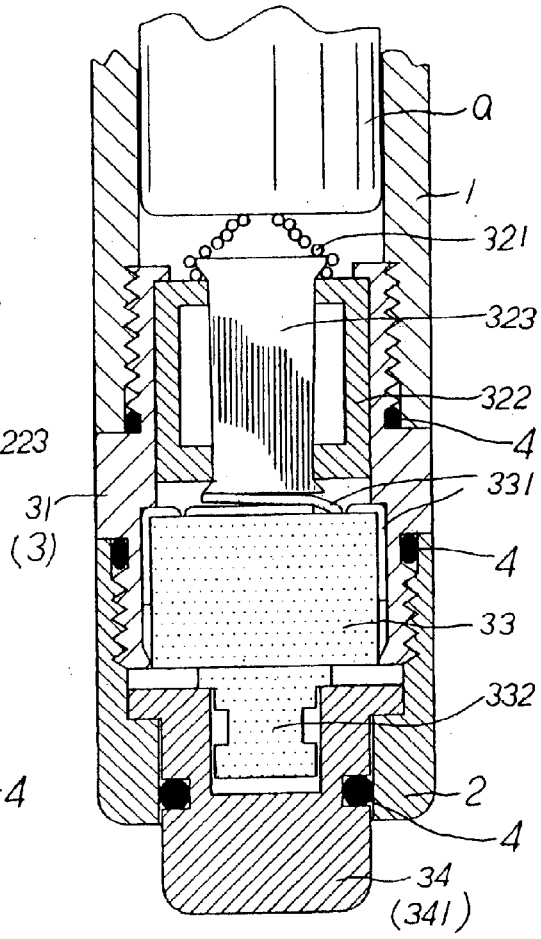
FIG. 10 is a plain view of another alternate form of the present invention.

FIG. 10 shows another alternate form of the present invention. According to this embodiment, the spring set 32 comprises a spring holder 322, a metal spring plate 323 mounted in the spring holder 322 and having its front and rear ends respectively extended out of the front and rear sides of the spring holder 322, and a metal spring 321 fastened to the front end of the metal spring plate 323 and disposed in contact with the negative terminal of the battery set a.

Figure 11:
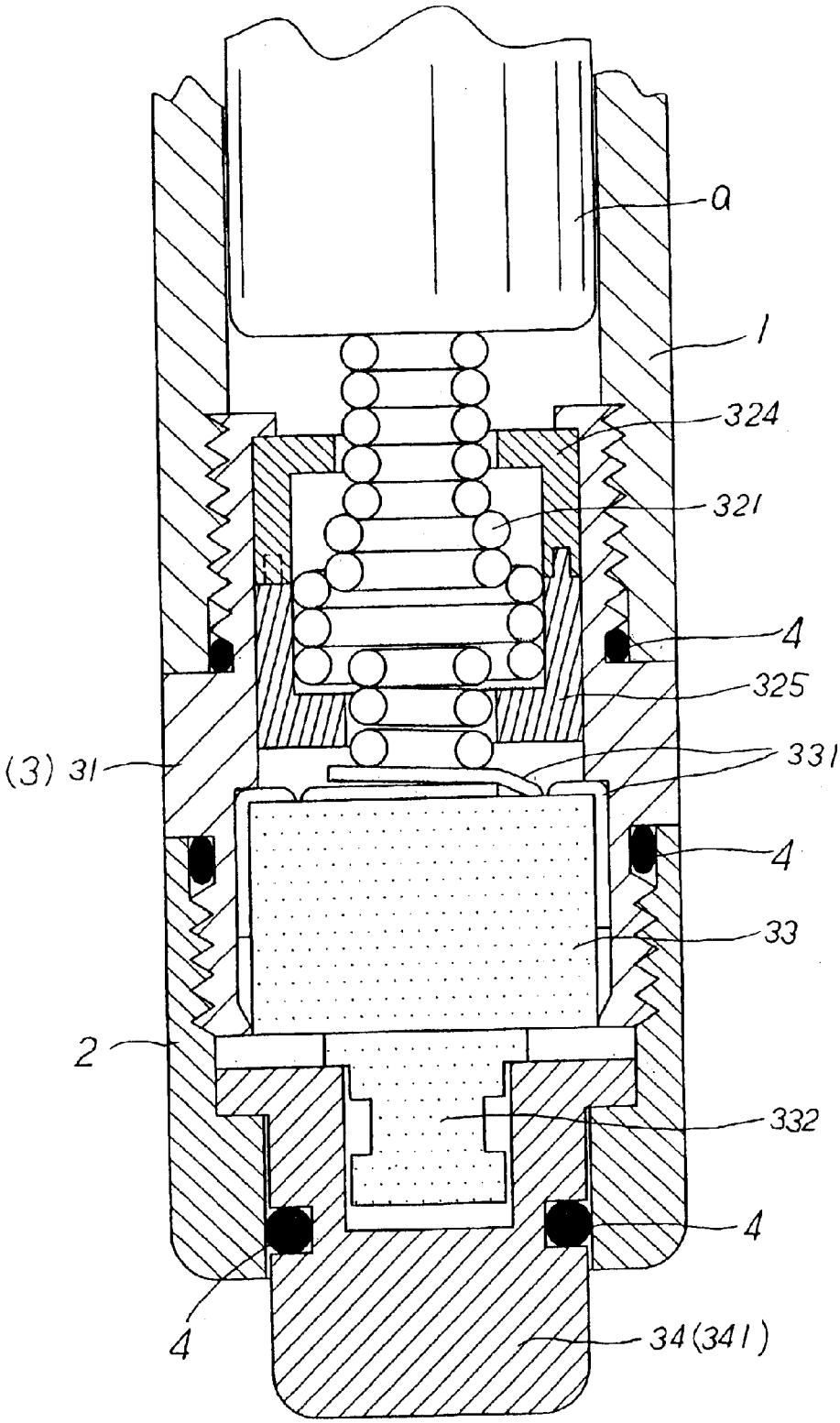
FIG. 11 is a plain view of still another alternate form of the present invention.

FIG. 11 shows still another alternate form of the present invention. According to this embodiment, the spring holder 322 is formed of a front half 324 and a rear half 325 fastened together by, for example, a tongue-and-groove joint.

Furthermore, gasket rings 4 may be provided in between the rotary rear cap 2 and the casing 31 as well as in between the casing 31 and the barrel 1 (see FIGS. 7A, 7B, 9, and 10).

According to the aforesaid embodiments, the rotary rear cap 2 is fastened to the rear end of the casing 31 to hold down the button 34, the switch body 33 and the spring set 32 in the casing 31 behind the annular stop flange 313 of the casing 31. Therefore, the spring set 32 does not fall out of the rotary rear cap 2 when the rotary rear cap 2 and the switch structure 3 disconnected from the barrel 1.

A prototype of rear pushbutton type switch arrangement for flashlight has been constructed with the features of FIGS. 6~10. The rear pushbutton type switch arrangement for flashlight functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A rear pushbutton type switch arrangement for flashlight comprising an aluminum alloy barrel holding a battery set and a lamp assembly, an electrically conducting rotary rear cap provided at a rear side of said barrel, and a switch structure mounted in said barrel and said rotary rear cap and partially extended out of said rotary rear cap for operation by the user to switch on/off the flashlight, wherein said switch structure comprises:

an externally threaded, electrically conducting, hollow, cylindrical metal casing, said casing having a front end threaded into a rear end of said barrel, a rear end threaded onto said rotary rear cap, a smaller front axial hole and a bigger rear axial hole axially connected in a line, and an annular stop flange in front of said small front axial hole;

a spring set mounted in the small front axial hole of said casing, said spring set comprising an electrically insulating spring holder mounted inside said casing and stopped behind the annular stop flange of said casing, and a metal spring isolated from said casing by said spring holder, said metal spring having a front end disposed in contact with the negative terminal of said battery set and a rear end;

a switch body mounted in the bigger rear axial hole of said casing, said switch body comprising two pairs of first front lead out pins transversely arranged in parallel at a front side thereof and overlapped for connection to the rear end of said metal spring, a pair of second front lead out pins bent bilaterally backwards and maintained attached to the periphery of said switch body for contacting an inside wall of said casing, and a rear switching rod; and a button coupled to the switching rod of said switch body and suspending in said rotary rear cap, said button having a press portion extended out of said rotary rear cap for operation by the user.

2. The rear pushbutton type switch arrangement for flashlight as claimed in claim 1 wherein said spring holder has a smaller front hole and bigger rear hole respectively disposed in front and rear ends thereof; said metal spring is mounted inside said spring holder, having the front end extended out of the small front hole of said spring holder and maintained in contact with the negative terminal of said battery set and the rear extended out of the big rear hole of said spring holder and maintained in contact with the pairs of first front lead out pins of said switch body.

3. The rear pushbutton type switch arrangement for flashlight as claimed in claim 2 wherein said spring holder has a rear annular stop flange transversely radially projecting in said bigger rear hole of the spring holder. and adapted to support the rear end of said metal spring in position.

4. The rear pushbutton type switch arrangement for flashlight as claimed in claim 1 wherein said switch body is press-fitted into the big rear axial hole of said casing to force the pair of second front lead out pins against an inside wall of said casing.

5. The rear pushbutton type switch arrangement for flashlight as claimed in claim 1 wherein said spring set further comprises a metal spring plate mounted inside said spring holder, said metal spring plate having a front end extended out of a front side of said spring holder and fastened to said metal spring and a rear end extended out of a rear side of said spring holder and maintained in contact with the pairs of first lead out pins of said switch body.

6. The rear pushbutton type switch arrangement for flashlight as claimed in claim 1 wherein said spring holder is formed of a front half and a rear half axially connected in a line.

* * * * *